US007458297B1

(12) United States Patent
Shiao

(10) Patent No.: US 7,458,297 B1
(45) Date of Patent: Dec. 2, 2008

(54) ELECTRONIC TORQUE WRENCH HAVING A TRIP UNIT

(76) Inventor: Hsuan-Sen Shiao, No. 55, Cheng-Feng Lane, Tai-Ming Rd., Wu-Jih Hsiang, Taichung Hsien (TW)

( * ) Notice: Subject to any disclaimer, the term of this patent is extended or adjusted under 35 U.S.C. 154(b) by 0 days.

(21) Appl. No.: 11/944,529

(22) Filed: Nov. 23, 2007

(51) Int. Cl.
*B25B 23/159* (2006.01)
*B25B 23/143* (2006.01)

(52) U.S. Cl. ..... 81/483; 81/479

(58) Field of Classification Search ..... 81/478–483
See application file for complete search history.

(56) References Cited

U.S. PATENT DOCUMENTS 3,577,815 A * 5/1971 Bergquist ..... 81/483
4,485,703 A 12/1984 Grabovac et al.
4,958,541 A 9/1990 Annis et al.
5,129,293 A 7/1992 Larson et al.
5,435,190 A 7/1995 Jansson et al.
6,070,506 A * 6/2000 Becker ..... 81/479
6,276,243 B1 * 8/2001 Jenkins ..... 81/479
6,722,235 B2 * 4/2004 Hsieh ..... 81/478
6,968,759 B2 11/2005 Becker et al.
6,981,436 B2 1/2006 Becker et al.
2007/0227316 A1 * 10/2007 Lucke et al. ..... 81/478

* cited by examiner

*Primary Examiner*—Hadi Shakeri

(57) ABSTRACT

An electronic torque wrench includes a tubular housing having a surrounding wall confining a receiving space, a working unit having a shank portion extending axially into the receiving space and pivoted to the surrounding wall at a pivot point, a strain sensor provided in the working unit, a trip unit having at least one driven element disposed in the shank portion, and a central processor connected electrically to the strain sensor and the trip unit. The driven element is movable to a tripping position, in which the driven element is not pressed tightly against the surrounding wall so that the working unit is permitted to pivot relative to the tubular housing. The central processor controls and moves the driven element to the tripping position when an applied torque measured by the strain sensor is larger than a preset reference torque value.

6 Claims, 7 Drawing Sheets

ELECTRONIC TORQUE WRENCH HAVING A TRIP UNIT

BACKGROUND OF THE INVENTION

1. Field of the Invention

This invention relates to a wrench, more particularly to an electronic torque wrench having a trip unit.

2. Description of the Related Art

Conventional torque wrenches can be divided into mechanical types, such as those disclosed in U.S. Pat. Nos. 4,485,703, 5,129,293, and 5,435,190, and electronic types, such as those disclosed in U.S. Pat. Nos. 4,958,541, 6,981,436, and 6,968,759. Generally, a conventional mechanical torque wrench includes a tubular housing, a lever connected pivotally to the tubular housing and aligned with the same in a normal state, a ratchet drive head connected to the lever, and a compression spring for biasing the lever. When the torque applied by the wrench to a bolt is larger than a biasing force of the compression spring, the lever is displaced slantingly until it bumps against the tubular housing. As such, the user can clearly feel the trip made by the lever. However, a drawback of this kind of wrench is that it is difficult to accurately design the compression spring to provide a desired preset biasing force. Therefore, a proper biasing force cannot be provided, especially when the compression spring experiences fatigue.

A conventional electronic torque wrench generally employs a plurality of strain gauges secured to a lever to produce a variable resistance to thereby measure an applied torque. When the torque applied by the wrench exceeds a preset torque value, a processing unit of the wrench will activate a vibrating motor, an audible alarm signal, or an illuminating lamp to warn the user. Although the conventional electronic torque wrench can accurately set the preset torque value through an electronic control method, since the lever cannot be displaced so as to bump against the tubular housing, the user cannot directly and clearly feel the tripping of the lever, so that the user is likely to stop the operation too late, thereby resulting in applying excessive torque.

SUMMARY OF THE INVENTION

Therefore, the object of the present invention is to provide an electronic torque wrench that can produce an accurate and direct trip similar to that of a mechanical torque wrench.

According to this invention, an electronic torque wrench comprises a tubular housing, a working unit, a strain sensor, a trip unit, and a central processor. The tubular housing has a surrounding wall that confines a receiving space having a longitudinal axis. The working unit has a drive head extending outwardly of the tubular housing, and a shank portion extending axially into the receiving space and pivoted to the surrounding wall at a pivot point. The strain sensor is provided in the working unit. The trip unit has at least one driven element disposed in the shank portion and movable between a non-tripping position and a tripping position. In the non-tripping position, the driven element is pressed tightly against the surrounding wall so that the working unit cannot pivot relative to the tubular housing. In the tripping position, the driven element is not pressed tightly against the surrounding wall so that the working unit is permitted to pivot relative to the tubular housing. The central processor is provided in the tubular housing, and is connected electrically to the strain sensor and the trip unit. The central processor controls and moves the driven element to the tripping position when an applied torque measured by the strain sensor is larger than a preset reference torque value.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
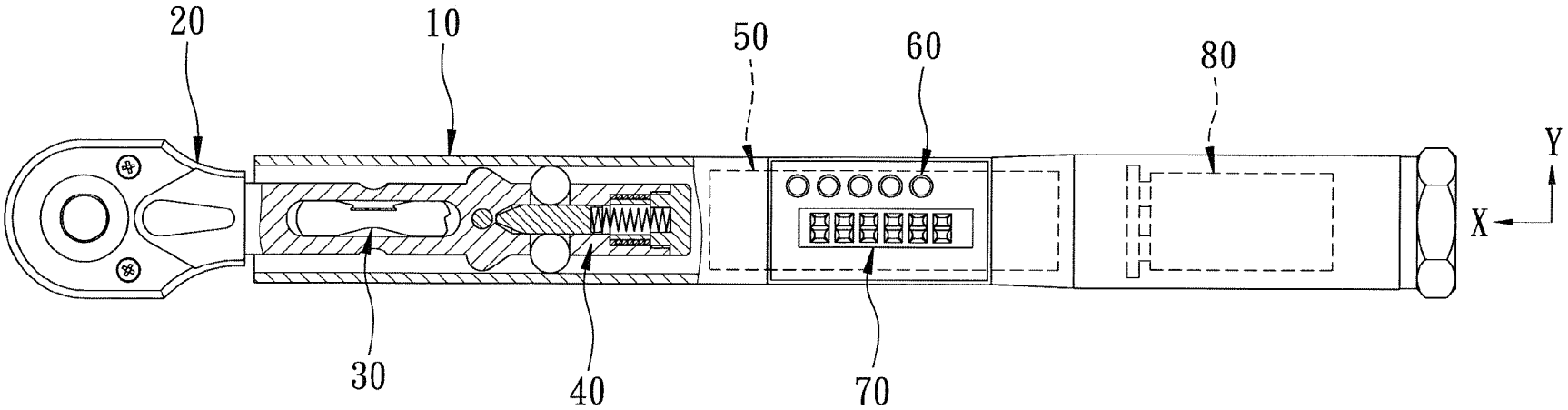
FIG. 1 is a fragmentary partly sectional view of the first preferred embodiment of an electronic torque wrench according to the present invention.

Before the present invention is described in greater detail, it should be noted that the same reference numerals have been used to denote like elements throughout the specification.

Referring to FIGS. 1 to 5, the first preferred embodiment of an electronic torque wrench according to the present invention is shown to comprise a tubular housing 10, a working unit 20, a strain sensor 30, a trip unit 40, a central processor 50, an input unit 60, a display unit 70, and a power supply 80.

The tubular housing 10 has a surrounding wall 11 confining a receiving space 12 that extends along a longitudinal X-axis.

The working unit 20 is connected pivotally to the tubular housing 10, and has a drive head 21 extending outwardly of the tubular housing 10, and a shank portion 22 extending axially into the receiving space 12 and pivoted to the surrounding wall 11 at a pivot point 25. The shank portion 22 includes a deflection neck 23 disposed between the drive head 21 and the pivot point 25, a slot 24 formed in the deflection neck 23 and extending along the longitudinal X-axis, a receiving hole 222 extending axially in the shank portion 22 at one side of the pivot point 25 opposite to the deflection neck 23 and having a tapered hole end portion 224 that is proximate to the pivot point 25 and that is tapered in a direction toward the drive head 21, and a transverse through hole 223 that extends along a transverse Y-axis, which is perpendicular to the longitudinal X-axis, that is formed between the pivot point 25 and the receiving hole 222, and that communicates spatially with the receiving hole 222.

The strain sensor 30 has a strain body 31 disposed in the slot 24, and a strain gauge 32 attached to the strain body 31. Alternatively, the strain sensor 30 may include a plurality of the strain gauges 32 attached to the strain body 31. The strain gauge 32 may be similar to that disclosed in U.S. Pat. Nos. 4,958,541, 6,981,436, and 6,968,759, and may be directly secured to the deflection neck 23.

Figure 2:
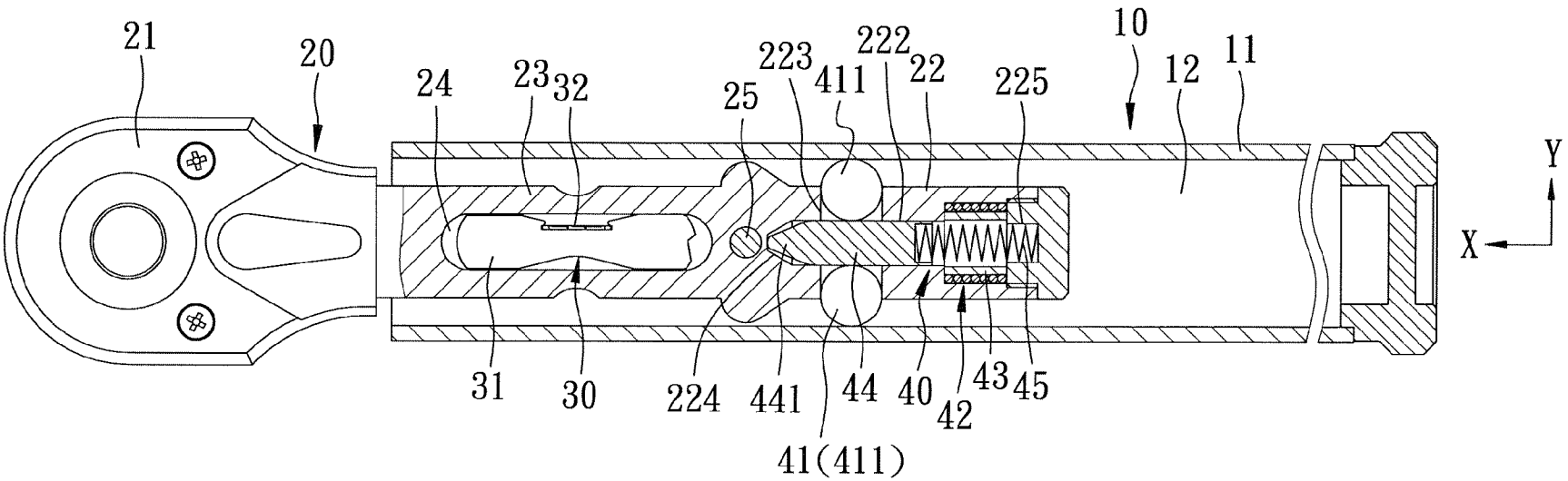
FIG. 2 is a fragmentary enlarged partly sectional view of the first preferred embodiment, illustrating a driven element of a trip unit in a non-tripping position.

The trip unit 40 has a driven element 41 and a control element 42 both disposed in the shank portion 22. In this embodiment, the trip unit 40 has a pair of the driven elements 41, preferably in the form of balls 411, disposed movably and respectively in two opposite open ends of the through hole 223 and protruding from the shank portion 22 in two opposite directions along the transverse Y-axis. The balls 411 are movable between a non-tripping position and a tripping position. In the non-tripping position, as shown in FIG. 2, the balls 411 are pressed tightly against the surrounding wall 11 so that the working unit 20 cannot pivot relative to the tubular housing 10. In the tripping position, as shown in FIGS. 4 and 5, the balls 411 are not pressed tightly against the surrounding wall 11 and are movable away from the surrounding wall 11, so that the working unit 20 is permitted to pivot relative to the tubular housing 10.

Figure 4:
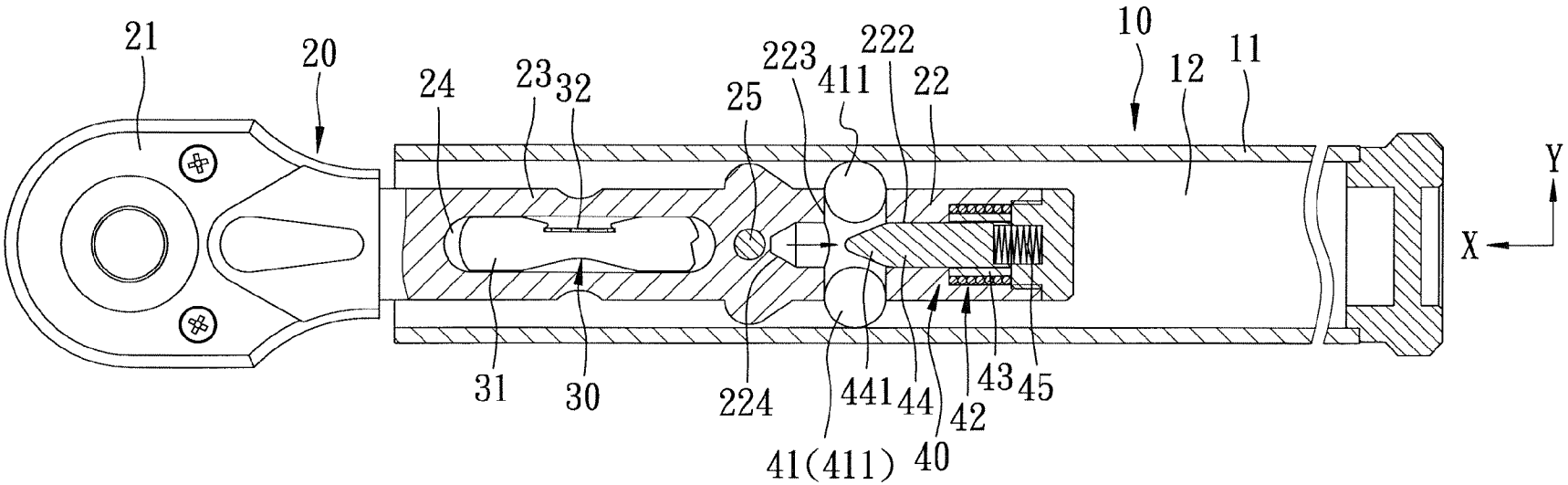
FIG. 4 is a view similar to FIG. 2, but illustrating the driven element of the trip unit in a tripping position.
Figure 5:
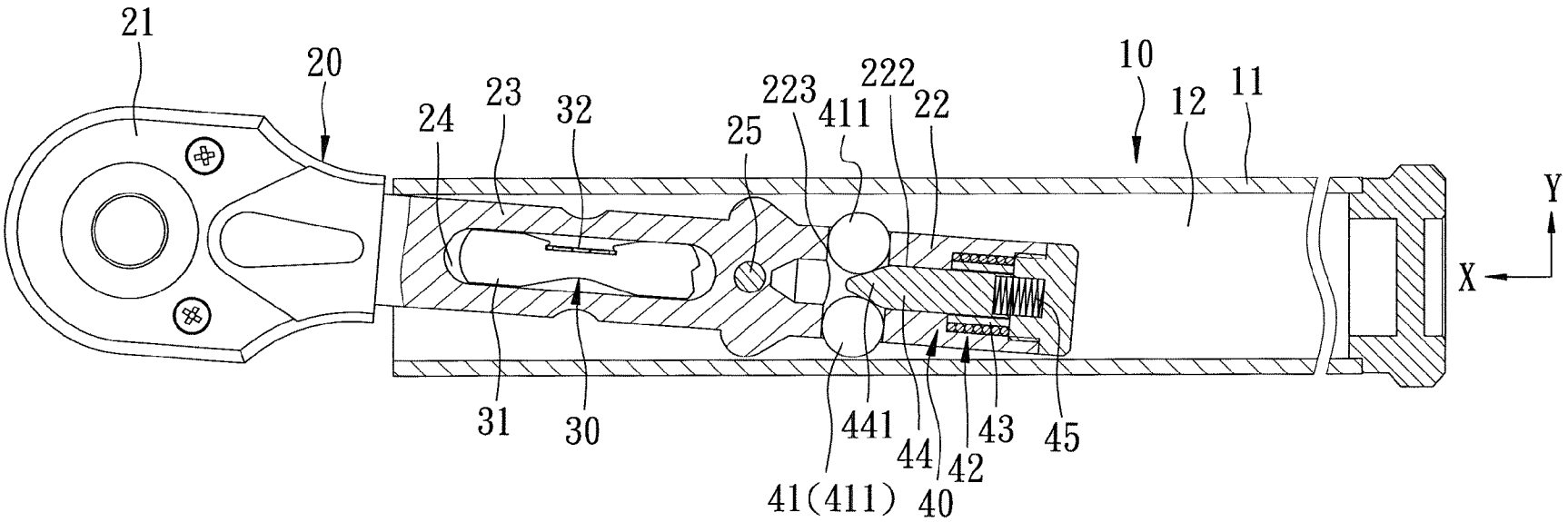
FIG. 5 is a view similar to FIG. 4, but illustrating a working unit pivoting to impact a tubular housing.

The control element 42 includes a spring 45, in the form of a compression spring, disposed axially in a rear hole portion 225 of the receiving hole 222, a solenoid coil 43 disposed in the receiving hole 222 around the spring 45 and connected electrically to the central processor 50, and a plunger 44 disposed in the receiving hole 222 and movable axially between a first state (see FIG. 2) and a second state (see FIGS. 4 and 5). The plunger 44 has a tapered front end portion 441 that is tapered in a direction toward the drive head 21 of the working unit 20. When the plunger 44 is in the first state, the plunger 44 is biased by the spring 45 to extend in between the balls 411 so as to press the balls 411 against the surrounding wall 11 of the tubular housing 10, thereby placing the balls 411 in the non-tripping position. At this time, the tapered front end portion 441 of the plunger 44 extends through the transverse through hole 223 and into the tapered hole end portion 224 of the receiving hole 222. When the plunger 44 is in the second state, the plunger 44 is retracted away from the balls 411 so as to release the same from pressing against the surrounding wall 11, and the tapered front end portion 441 of the plunger 44 is moved away from the tapered hole end portion 224 of the receiving hole 222, thereby placing the balls 411 in the tripping position. At this time, the spring 45 is compressed by the plunger 44, and the tapered front end portion 441 of the plunger 44 is located partially in the transverse through hole 223 between the balls 411, as best shown in FIGS. 4 and 5.

The central processor 50 is disposed in the receiving space 12, and is connected electrically to the strain gauge 32 and the solenoid coil 43. In this embodiment, the central processor 50 has a conventional circuit board, and may utilize a conventional layout of conventional circuit components, such as a Wheatstone bridge, an amplifier, a recorder, a microprocessor, etc. Hence, the central processor 50 is not detailed herein.

The input unit 60 and the display unit 70 are provided on the tubular housing 10, and are connected electrically to the central processor 50. A user can enter a preset reference torque value of a desired maximum torque into the central processor 50 through the input unit 60, and the preset reference torque value is shown on the display unit 70. Since the input unit 60 and the display unit 70 are known in the art, a detailed description of the same is dispensed herewith for the sake of brevity.

The power supply 80 is disposed in the receiving space 12, and is connected electrically to the solenoid coil 43 and the central processor 50. In this embodiment, the power supply 80 is a battery.

Figure 3:
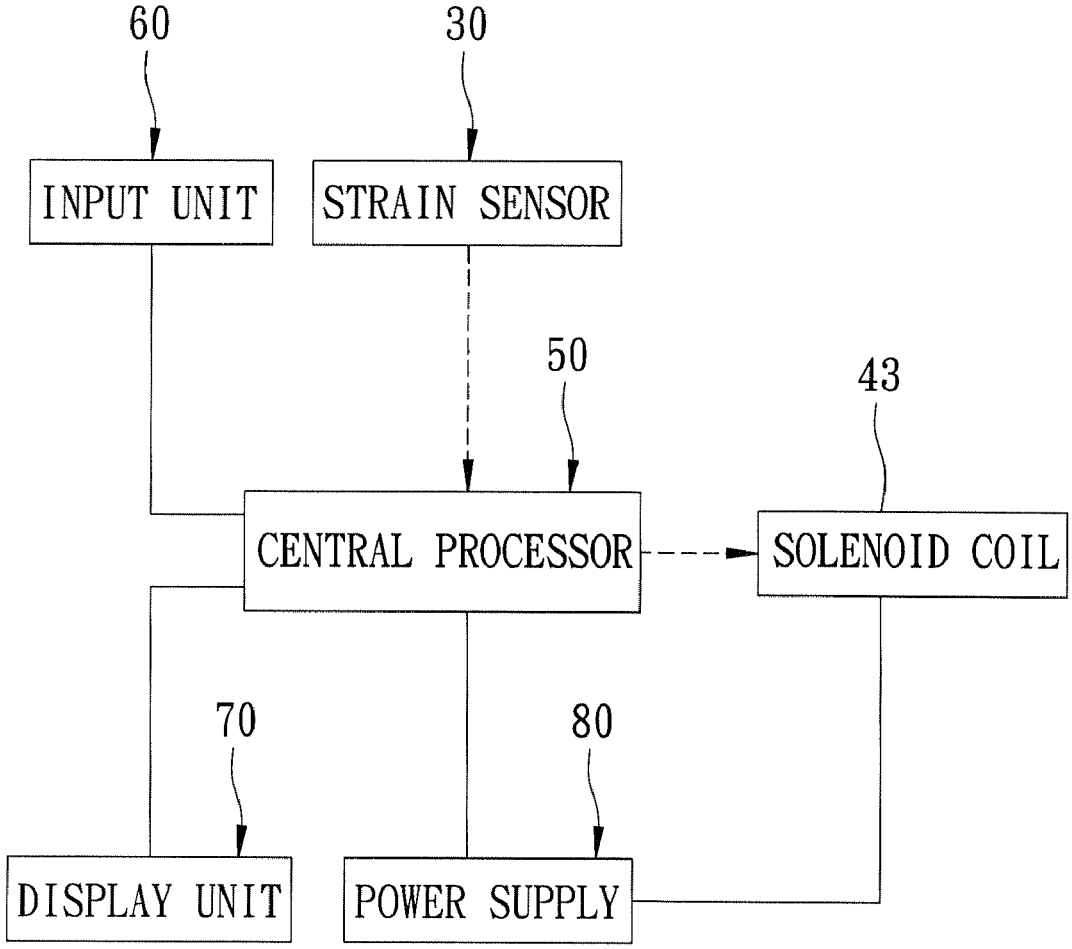
FIG. 3 is a block diagram of the first preferred embodiment.

With reference to FIGS. 2 and 3, when a torque is applied to a workpiece, such as a bolt (not shown) or the like, through the drive head 21 of the working unit 20 which is fitted to a socket (not shown), the central processor 50 determines whether or not the measured torque value of the strain sensor 30 has exceeded the preset reference torque value. When the measured torque value is smaller than the preset reference torque value, the solenoid coil 43 is not activated by the central processor 50 to produce a magnetic force, so that the plunger 44 is maintained in the first state, i.e., the plunger 44 extends in between the balls 411, and the balls 411 are pressed against the surrounding wall 11 of the tubular housing 10. As such, the working unit 20 cannot pivot relative to the tubular housing 10 and remains aligned with the longitudinal X-axis.

With reference to FIGS. 3, 4, and 5, when the central processor 50 determines that the measured torque value of the strain sensor 30 has exceeded the preset reference torque value, the solenoid coil 43 is activated by the central processor 50 to produce a magnetic force, and attracts the plunger 44 thereto, so that the plunger 44 retracts away from the balls 411, and is moved from the first state to the second state. In this second state, the plunger 44 compresses the spring 45, and the tapered front end portion 441 of the plunger 44 moves away from the tapered hole end portion 224 until disposed partially between the balls 411. At this time, the balls 411 are movable within the through hole 223, and are not pressed against the surrounding wall 11 of the tubular housing 10. Hence, the working unit 20 is permitted to displace and swing relative to the tubular housing 10 so as to impact the surrounding wall 11 of the tubular housing 10.

When no force is exerted on the drive head 21 (or a small enough force is exerted thereon such that the measured torque value falls below the preset reference torque value), the central processor 50 stops activating the solenoid coil 43, and through the restoring action of the spring 45, the plunger 44 is biased by the spring 45 to move toward the first state again, that is, the tapered front end portion 441 of the plunger 44 extends back into the tapered hole end portion 224 of the receiving hole 222, and the plunger 44 extends in between the balls 411 so as to press the balls 411 against the surrounding wall 11 of the tubular housing 10. Consequently, the working unit 20 is again aligned with the longitudinal X-axis (see FIGS. 1 and 2).

From the aforementioned description, the advantages of the present invention can be summarized as follows:

The present invention not only can accurately set the preset reference torque value through electronic control, but also, through the use of the solenoid coil 43 to control the movement of the plunger 44, the balls 411 can be released from a state of pressing tightly against the surrounding wall 11 of the tubular housing 10, so that the working unit 20 can swing relative to the tubular housing 10 and impact the surrounding wall 11 thereof, thereby allowing the user to directly and clearly feel a tripping action of the wrench of the present invention. The user can then stop applying force to the wrench.

Figure 6:
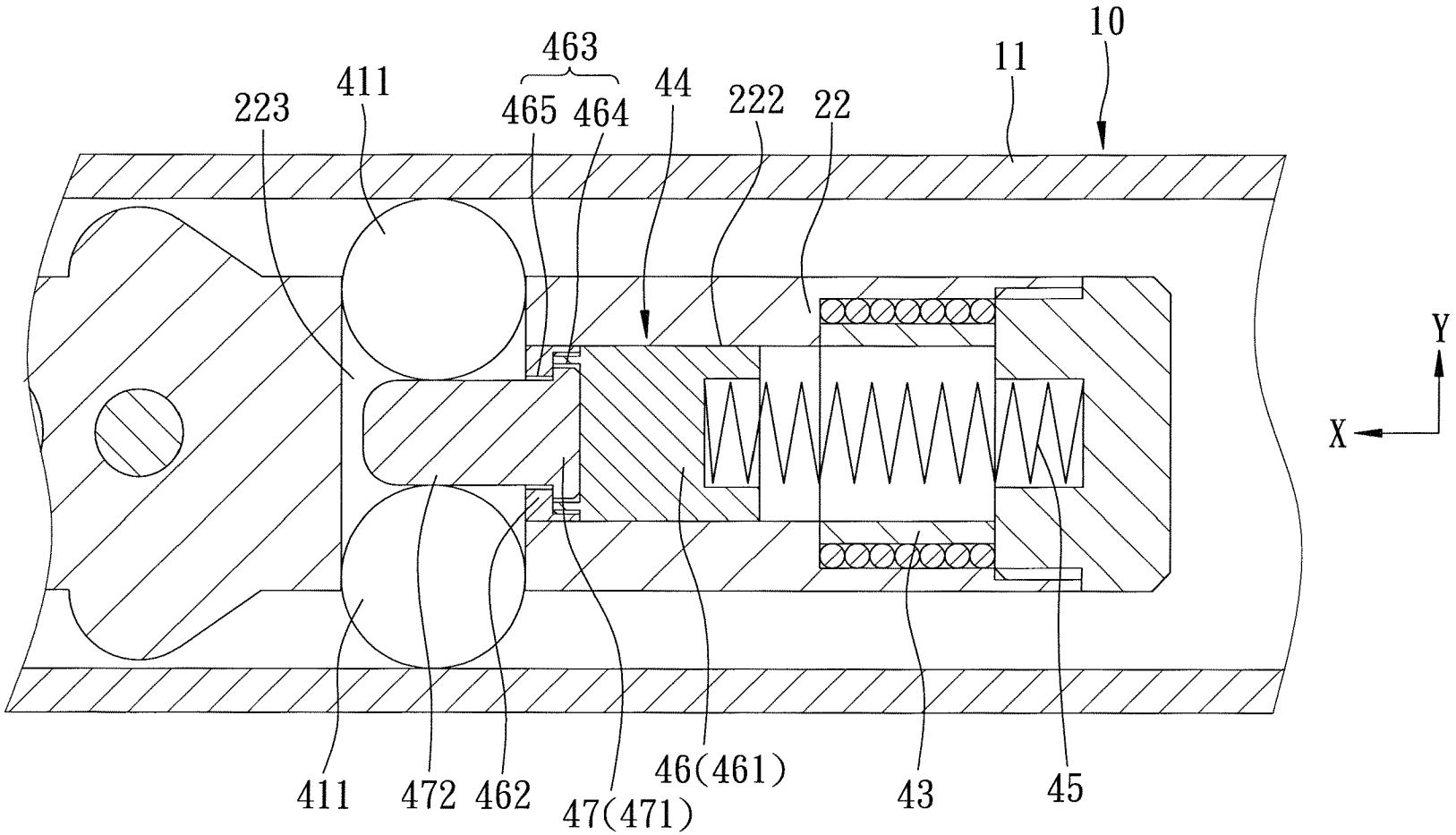
FIG. 6 is a fragmentary enlarged sectional view of a trip unit of an electronic torque wrench according to the second preferred embodiment of the present invention.
Figure 7:
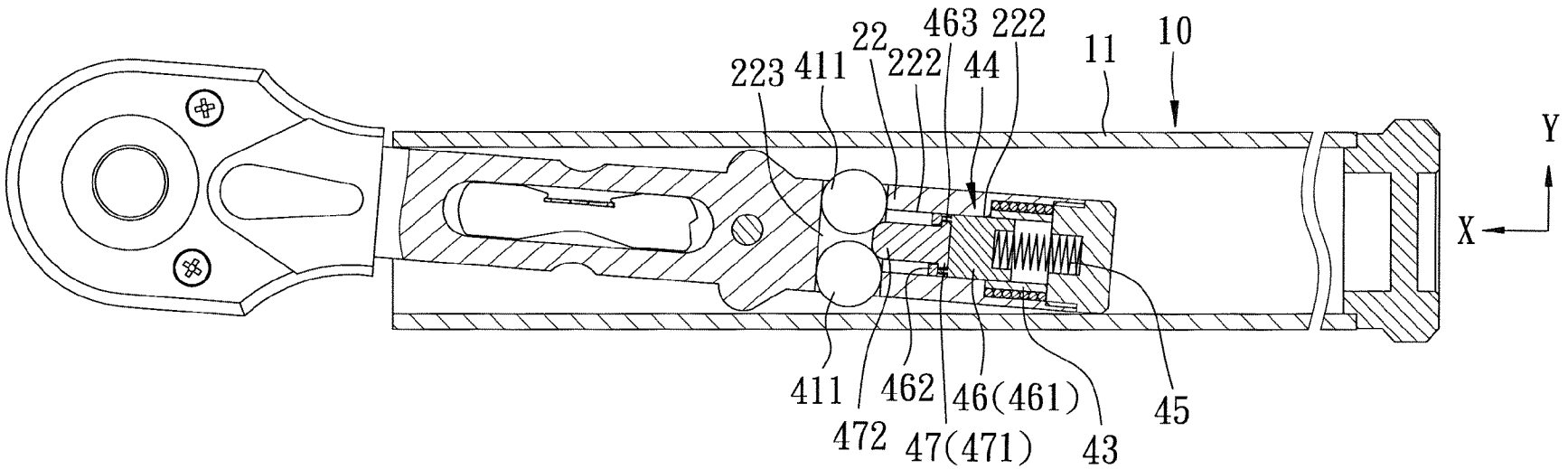
FIG. 7 is a fragmentary partly sectional view of the second preferred embodiment, illustrating a working unit pivoting to impact a tubular housing.

Referring to FIGS. 6 and 7, an electronic torque wrench according to the second preferred embodiment of the present invention is shown to be similar to the first preferred embodiment. However, in this embodiment, the plunger 44 includes a first section 46 disposed movably in the receiving hole 222 and having a connecting hole 463, and a second section 47 connected movably to the connecting hole 463. The connecting hole 463 has a large hole section 464, and a small hole section 465 communicating with the large hole section 464 and having a width smaller than that of the large hole section 464. The first section 46 further has a main part 461 defining the large hole section 464, and a ring part 462 connected threadedly to the main part 461 and defining the small hole section 465.

The second section 47 has an enlarged end portion 471 extending into the large hole section 464, and a constricted portion 472 extending out of the connecting hole 463 through the small hole section 465. Since the enlarged end portion 471 has a width smaller than a diameter of the large hole section 464, and the constricted portion 472 has a width smaller than a diameter of the small hole section 465, the second section 47 is movable limitedly relative to the first section 46 along the transverse Y-axis.

With reference to FIG. 6, when the plunger 44 is in the first state, the plunger 44 is biased by the spring 45 so that the constricted portion 472 of the second section 47 extends into the transverse through hole 223 in between the balls 411 so as to press the balls 411 against the surrounding wall 11 of the tubular housing 10, thereby placing the balls 411 in the non-tripping position.

With reference to FIG. 7, when the plunger 44 is in the second state, the solenoid coil 43 is activated to retract the constricted portion 472 of the second section 47 away from the balls 411, thereby placing the balls 411 in the tripping position. As such, the working unit 20 is permitted to displace and swing relative to the tubular housing 10 so as to impact the surrounding wall 11 of the tubular housing 10.

Therefore, the second preferred embodiment not only can attain an effect similar to that of the first preferred embodiment, but also, the compression force applied by the balls 411 to the second section 47 can be prevented from transmitting to the first section 46 and the shank portion 22.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. An electronic torque wrench, comprising:

a tubular housing having a surrounding wall that confines a receiving space having a longitudinal axis;

a working unit having a drive head extending outwardly of said tubular housing, and a shank portion extending axially into said receiving space and pivoted to said surrounding wall at a pivot point;

a strain sensor provided in said working unit;

a trip unit having a pair of driven elements protruding from said shank portion in two opposite directions transverse to said longitudinal axis and movable to and away from said surrounding wall, said driven elements being further movable between a non-tripping position, in which said driven elements are pressed tightly against said surrounding wall so that said working unit cannot pivot relative to said tubular housing, and a tripping position, in which said driven elements are not pressed tightly against said surrounding wall so that said working unit is permitted to pivot relative to said tubular housing, said trip unit further having a control element disposed in said shank portion to press or release said driven elements and connected electrically to said central processor; and a central processor provided in said tubular housing and connected electrically to said strain sensor and said trip unit, said central processor controlling and moving said driven element to said tripping position when an applied torque measured by said strain sensor is larger than a preset reference torque value;

wherein said control element has a plunger disposed in said shank portion and movable axially so as to extend in between and push said driven elements against said surrounding wall, or to retract away from and release said driven elements; and wherein said control element further has a spring biasing said plunger to extend in between said driven elements, and a solenoid coil to retract said plunger from said driven elements.

2. The electronic torque wrench of claim 1, wherein said shank portion has a deflection neck disposed between said drive head and said pivot point, a receiving hole extending axially in said shank portion at one side of said pivot point opposite to said deflection neck, and a transverse through hole disposed in said shank portion between said pivot point and said receiving hole and receiving said driven elements, said plunger being movable into said transverse through hole.

3. The electronic torque wrench of claim 2, wherein said plunger has a first section disposed movably in said receiving hole and having a connecting hole, and a second section connected movably to said connecting hole, said connecting hole having a large hole section, and a small hole section having a width smaller than that of said large hole section, said second section having an enlarged end portion extending into said large hole section, and a constricted portion extending out of said connecting hole through said small hole section, said second section being movable limitedly and transversely relative to said first section.

4. The electronic torque wrench of claim 3, wherein said first section further has a main part, and a ring part connected threadedly to said main part, said ring part defining said small hole section, said main part defining said large hole section that communicates with said small hole section.

5. The electronic torque wrench of claim 2, wherein said plunger has a tapered front end portion that is tapered in a direction toward said drive head of said working unit.

6. The electronic torque wrench of claim 1, wherein said shank portion has a deflection neck connected to said drive head, and a slot formed in said deflection neck, said strain sensor having a strain body disposed in said slot, and a strain gauge installed on said strain body.

* * * * *